US006279777B1

(12) United States Patent
Goodin et al.

(10) Patent No.: US 6,279,777 B1
(45) Date of Patent: Aug. 28, 2001

(54) DISPENSING CONTROL SYSTEM

(75) Inventors: John W. Goodin, Coto de Caza; Peter A. Regla, Placentia; Kenneth B. Gerenraich; Edward M. Pribonic, both of Seal Beach, all of CA (US)

(73) Assignee: Woodward Laboratories, Inc., Los Alamitos, CA (US)

( * ) Notice: Subject to any disclaimer, the term of this patent is extended or adjusted under 35 U.S.C. 154(b) by 0 days.

(21) Appl. No.: 09/395,488

(22) Filed: Sep. 14, 1999

(51) Int. Cl.[7] ..... B67D 5/33
(52) U.S. Cl. ..... 222/52; 222/504; 340/573.1
(58) Field of Search ..... 222/52, 63, 504; 340/573.1

(56) References Cited

U.S. PATENT DOCUMENTS

| | | | | |
|---|---|---|---|---|
| 3,505,692 | * | 4/1970 | Forbes | 222/52 X |
| 4,449,122 | | 5/1984 | Whitmer | 340/562 |
| 4,722,372 | | 2/1988 | Hoffman et al. | 141/98 |
| 4,879,461 | | 11/1989 | Philipp | 250/221 |
| 4,921,131 | | 5/1990 | Binder Bauer et al. | 222/52 |
| 4,938,384 | | 7/1990 | Pilolla et al. | 222/52 |
| 4,946,070 | * | 8/1990 | Albert et al. | 222/52 |
| 4,967,935 | | 11/1990 | Celest | 222/63 |
| 5,086,526 | | 2/1992 | Van Marcke | 4/623 |
| 5,105,992 | * | 4/1992 | Fender et al. | 222/52 X |
| 5,199,118 | | 4/1993 | Cole et al. | 4/619 |
| 5,217,035 | | 6/1993 | Van Marcke | 137/1 |
| 5,255,822 | * | 10/1993 | Mease et al. | 222/63 |
| 5,492,247 | | 2/1996 | Shu et al. | 222/63 |
| 5,625,908 | | 5/1997 | Shaw | 4/623 |
| 5,632,414 | | 5/1997 | Merriweather, Jr. | 222/52 |
| 5,651,044 | | 7/1997 | Klotz, Jr. et al. | 378/117 |
| 5,695,091 | * | 12/1997 | Winings et al. | 222/52 X |
| 5,730,165 | | 3/1998 | Philipp | 137/1 |
| 5,781,942 | | 7/1998 | Allen et al. | 4/623 |
| 5,810,201 | * | 9/1998 | Besse et al. | 222/52 X |
| 5,862,844 | * | 1/1999 | Perrin | 222/52 X |
| 5,933,288 | | 8/1999 | Plesko | 359/896 |
| 5,952,835 | | 9/1999 | Coveley | 324/671 |
| 5,960,991 | * | 10/1999 | Ophardt | 222/52 X |

* cited by examiner

*Primary Examiner*—Kevin Shaver
*Assistant Examiner*—Eric Keasel
(74) *Attorney, Agent, or Firm*—Walter A. Hackler

(57) ABSTRACT

A system for controlling operation of a device in response to the presence of a human body part includes a theremin for detecting the presence of a human body part in an area and producing a first output signal in response to the detection. A second sensor separately detects the presence of a human body part in the area and produces a second output signal in response to the separate detection. A processor determines the presence of both the first and second output signals and in response thereto provides a control signal to the device.

11 Claims, 6 Drawing Sheets

DISPENSING CONTROL SYSTEM

BACKGROUND OF THE INVENTION

The present invention is generally related to automatic control systems and is more particularly directed to a system for controlling operation of a device in response to the presence of a human body part.

It is preferable to operate many devices without direct handling thereof by human interaction. For example, it is preferable for sanitary reasons in washing to avoid the need for physical contact with faucet handles, towel dispensers, hand driers, soap dispensers, and the like.

While a number of control systems have been developed for such touch-free control in order to conserve water and soap, they have been plagued by false activation. That is, devices are turned on without the actual presence of a human body part. This, of course, leads to fluid waste which is contrary to the original purpose of the control system.

Further, in the case of soap dispensers and the like, safety becomes a factor when such liquids are falsely dispensed and end up on a floor, or other surface, where subsequent slippage thereon may cause bodily harm.

Attempts to solve the problem of false operation have included elaborate electronic circuitry, which is, of course, expensive and, further, subject to failure itself.

The present invention provide for a relatively inexpensive, easily controlled system which automatically senses the presence of a human body part to operate a device. When utilized in a washing facility, the present invention may be used to operate faucet valves, soap dispensers and hand driers, and which minimizes power consumption so that batteries may be utilized for powering the control system.

SUMMARY OF THE INVENTION

A system for controlling operation of a device in response to the presence of a human body part generally includes Theremin means for detecting the presence of a human body part in an area, and producing a first output signal in response to the detection. Sensor means are also provided for separately detecting the presence of the human body part in the area and producing a second output signal in response to the separate detection.

Processing means are provided for determining the presence of both the first and second output signals and in response thereto, providing a control signal to the device. Because separate independent detection of the human body part is provided, the likelihood of false operation is significantly reduced, if not eliminated.

The Theremin means preferably includes two closely spaced, yet separated, antenna panels which establish a capacitance therebetween. The panels are "free floating" in that no ground is provided. This feature enables the use of the control system in applications where no ground is available. A change in the capacitance due to the presence of a human body part thereby is used to provide the first output signal.

An oscillator is provided and connected between the antenna panels for providing the output corresponding to the capacitance change between the two antenna panels. A second oscillator and comparator means for comparing the output from the second oscillator with the first oscillator output are provided for digitizing the difference in frequency and generating a control current for the device.

More particularly, the sensor means may comprise an infrared detector, an ultrasonic detector, a heat detector, a visible light detector, a proximity detector or an audio detector capable of producing an output upon sensing, or detecting, the body part.

The invention also provides for a system of dispensing of a fluid in response to the presence of a human hand, in which case the system includes a fluid dispensing device for releasing a measured amount of fluid in response to a control signal. A Theremin is provided for detecting the presence of a hand proximate the fluid dispenser and producing a first output signal in response thereto. Sensor means is provided for independently detecting the presence of a hand proximate the fluid dispenser and producing a second output signal in response to the independent detection. A processor is provided for determining the simultaneous presence of both the first and second output signals in response thereto producing decontrolled signal for the fluid dispensing device.

In this embodiment, the Theremin means includes two spaced apart antenna panels which are shaped to conform to a user's hand in order to maximize, through efficient coupling with the user's hand, capacitance change therebetween without contact with the user's hand.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
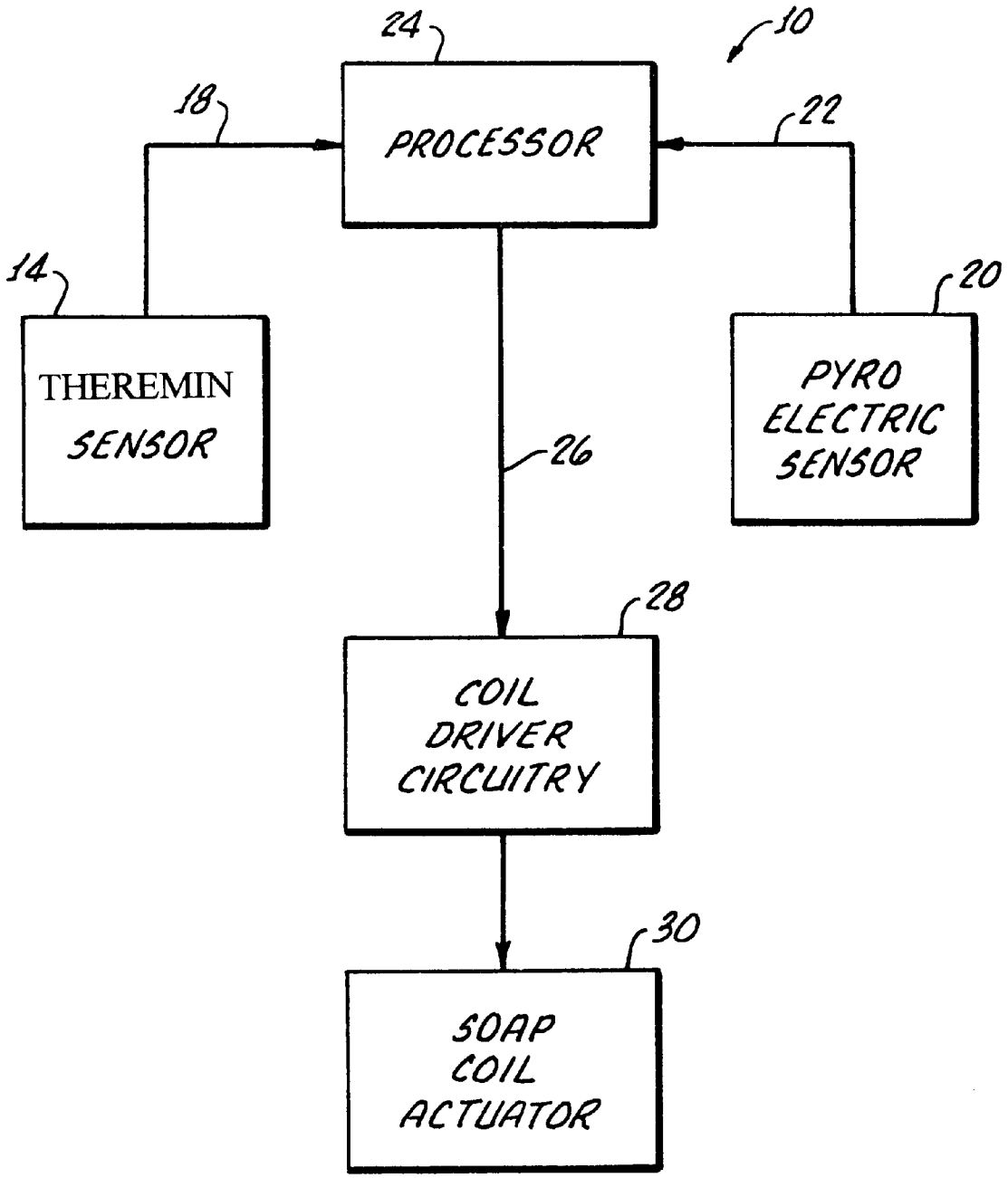
FIG. 1 is a block diagram of the system for controlling operation of a device such as, for example, a fluid dispenser.
Figure 7:
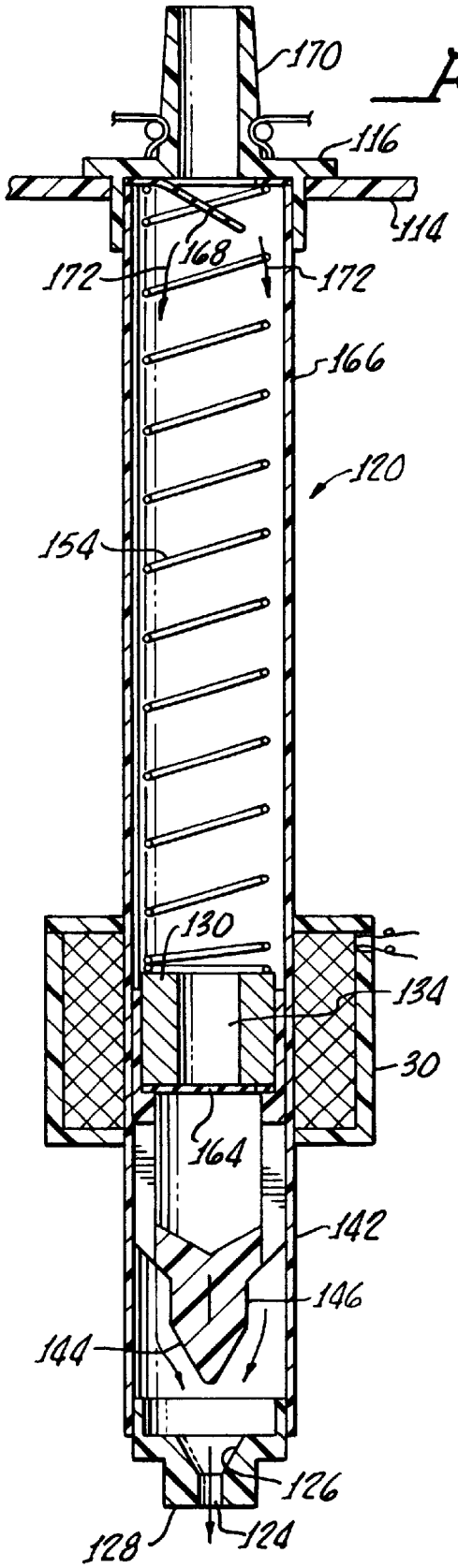
FIG. 7 is a cross sectional view similar to FIG. 6, showing the plunger beginning downward movement under the force of the spring, with the first one-way valve closed, and a second one-way valve, at a top of the tubular dispenser, open for enabling flow of fluid into the tube from the reservoir.
Figure 8:
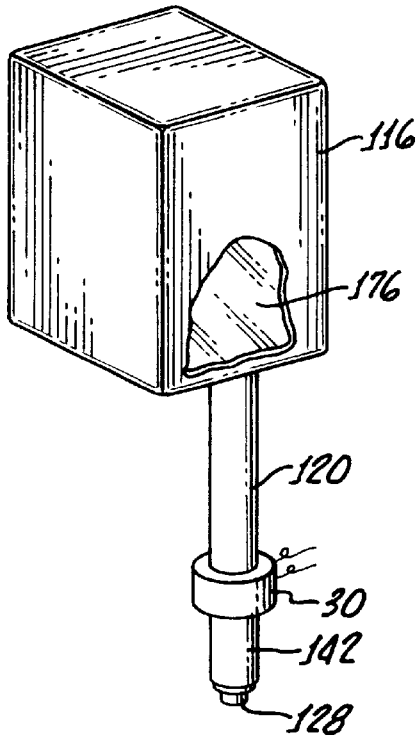
FIG. 8 is a perspective view of the reservoir and the dispensing tube removed from the housing.
Figure 9:
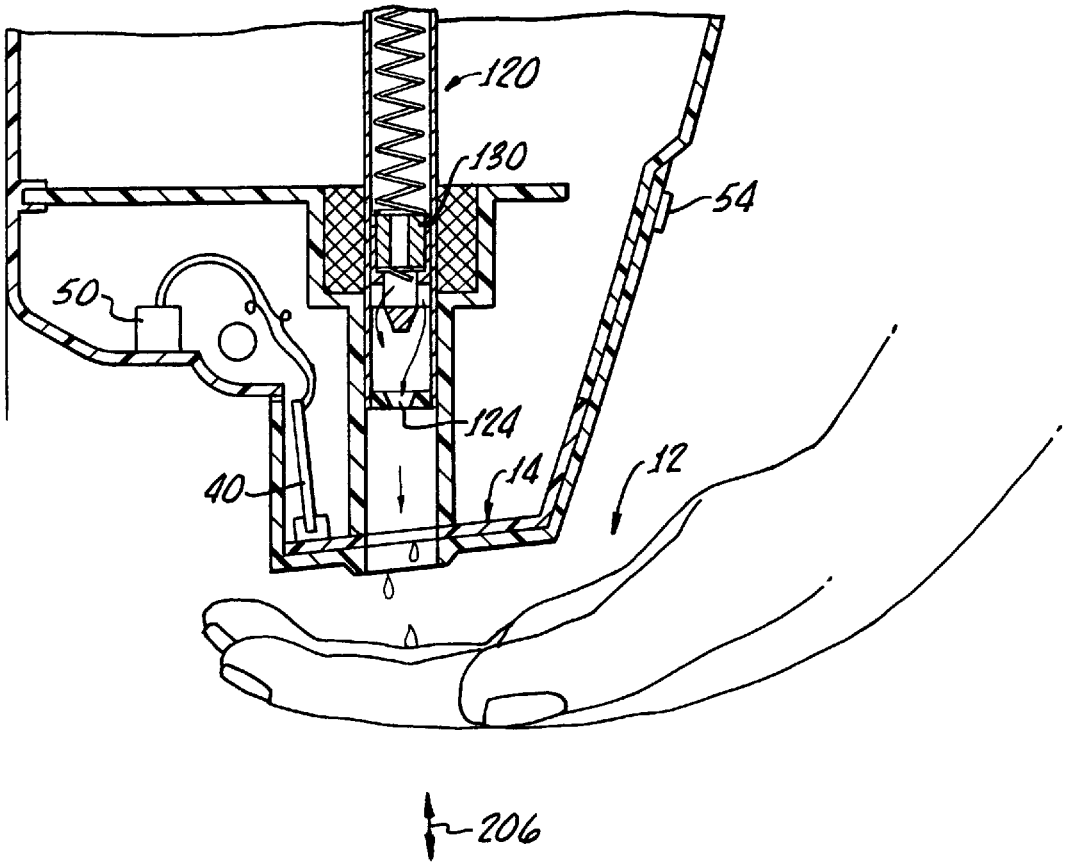
FIG. 9 is a cross sectional view of the dispenser more clearly showing the Theremin antenna disposed in a spaced apart relationship with the valve seat and orifice along with a second sensor for confirming presence of the user's palm, a light sensor suitable for cutting power to the control system in order to preserve electrical power may also be provided.

With reference to FIG. 1, there is shown in block diagram form, a system 10 for controlling operation of a device such as a fluid dispenser 110, shown in FIGS. 3–10, in response to the presence of a human body part, such as a user's hand, or palm 12, (see FIG. 9).

This system generally includes a Theremin means 14 for detecting the presence of the human body part in an area 16 (see FIG. 9) and producing a first output signal 18 in response to the detection. A second sensor means 20 is provided for separately detecting the presence of the human body part in the area 16 and producing a second output signal 22 in response to the separate detection.

In general, a processor 24 provides a means for determining the presence of both the first and second output signals 18, 22 and in response thereto, providing a control signal 26 to a coil driver circuit 28 to power an actuator 30.

Figure 2:
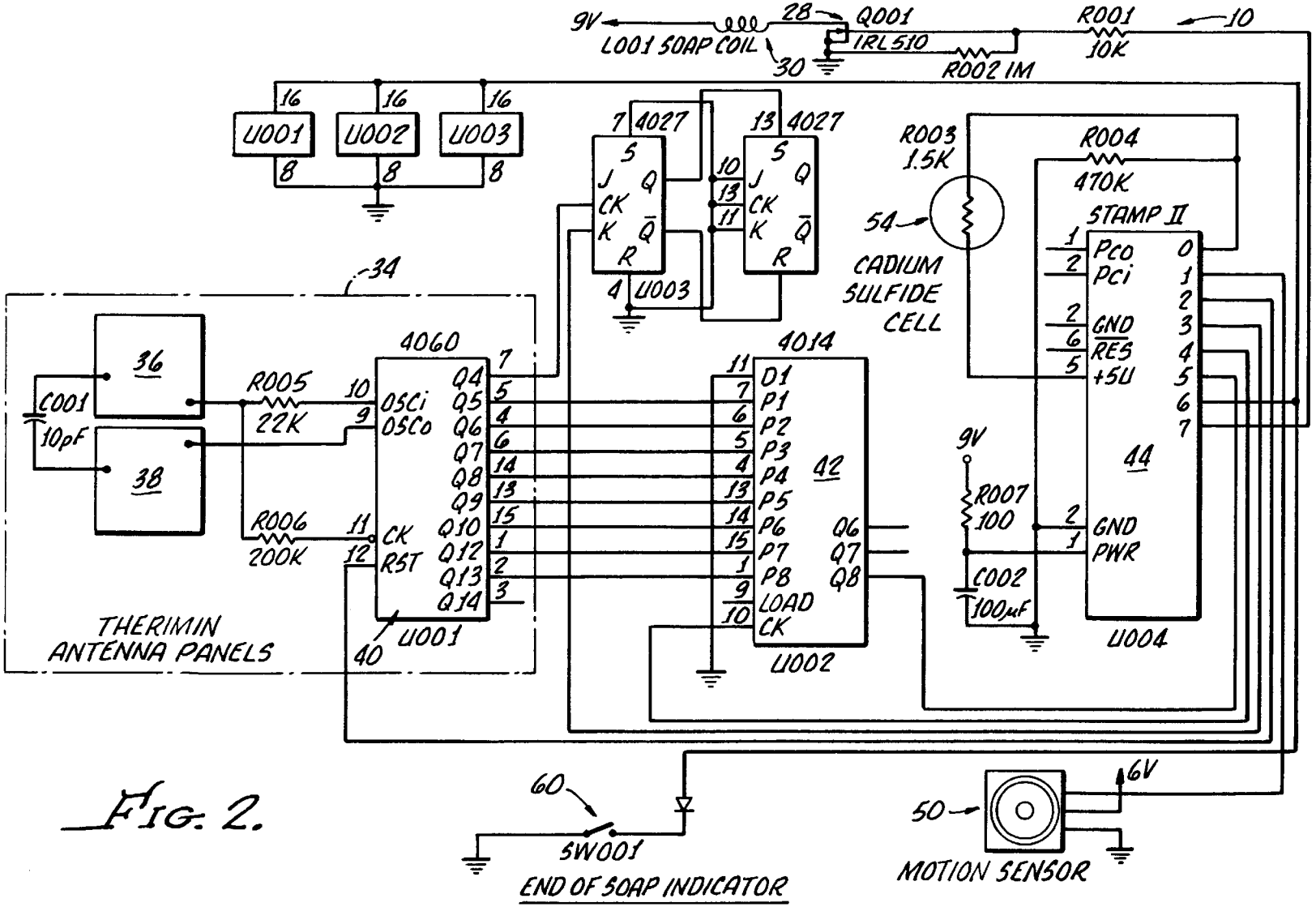
FIG. 2 is a schematic diagram of the system block diagrammed in FIG. 1.

With reference to FIG. 2, the control system 10 in accordance with the present invention includes Theremin means 34 for detecting the presence of the user's palm 12 (not shown in FIG. 2) in an area 16 and producing the first output signal 18. As represented in FIG. 2, the Theremin means 34 includes two closely spaced apart antenna panels 36, 38 for establishing a capacitance therebetween independent of any ground connection. Preferably, the panels 36, 38 are formed in a shape, as hereinafter described in greater detail, for enhancing coupling with the user's palm 12.

An oscillator 40 interconnected between the panels 36, 38 provides an output corresponding to the capacitance of the two panels 36, 38. The oscillator 40 provides a digital output to a serial latch 42 which provides a digital output to a second oscillator/comparator 44 which, upon determining a change in capacitance between the panels 36, 38 (due to the presence of the user's palm 12), provides an output current to the coil drive 28 and solenoid coil 30.

With the use of a second sensor for separately detecting the presence of the user's palm 12 in the area 16, and producing an output corresponding thereto, the oscillator/comparator 44 functions as a processing means for determining the presence of both the first and second outputs and providing the control signal/current to the driver 28.

As hereinafter noted, the second sensor 50 may be any conventional infrared, ultrasonic, heat, light, proximity or audio sensor/detector. The independent sensing of a user's hand and confirmation by the processor 44 ensures that accidental or false signals will not be caused which would result in unwanted operation of the device 100.

A cadmium sulfite cell 54 provides a light sensor means for deactivating the control system 10 at a low light level in order to conserve electrical energy. This is particularly important when batteries 56 are utilized for powering the control system 10.

In addition, a pressure sensitive switch, or the like, 60 may be utilized as a low level, or end-of-soap indicator, which may be also used to turn off the control system 10.

Figure 3:
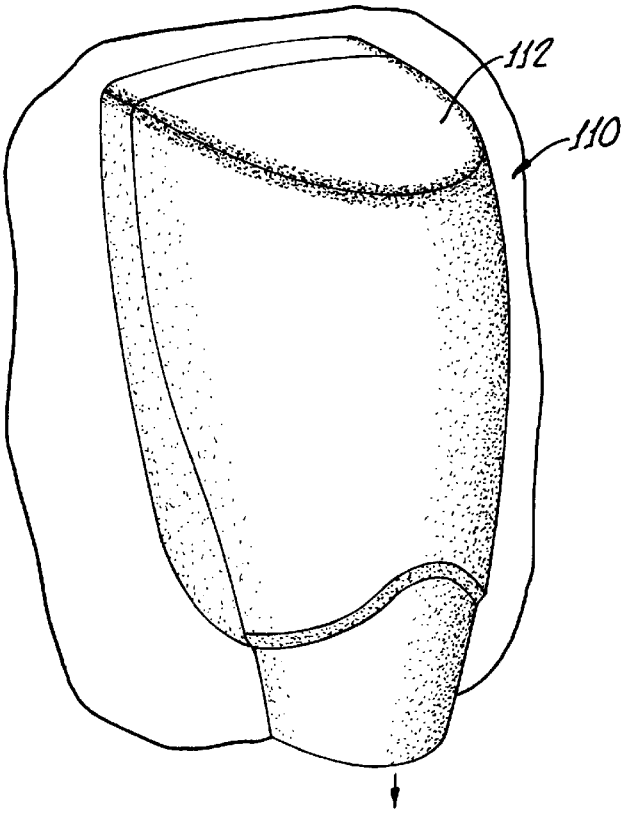
FIG. 3 is a perspective view of a fluid dispenser illustrating the type of device controlled by the system shown in FIGS. 1 and 2.
Figure 4:
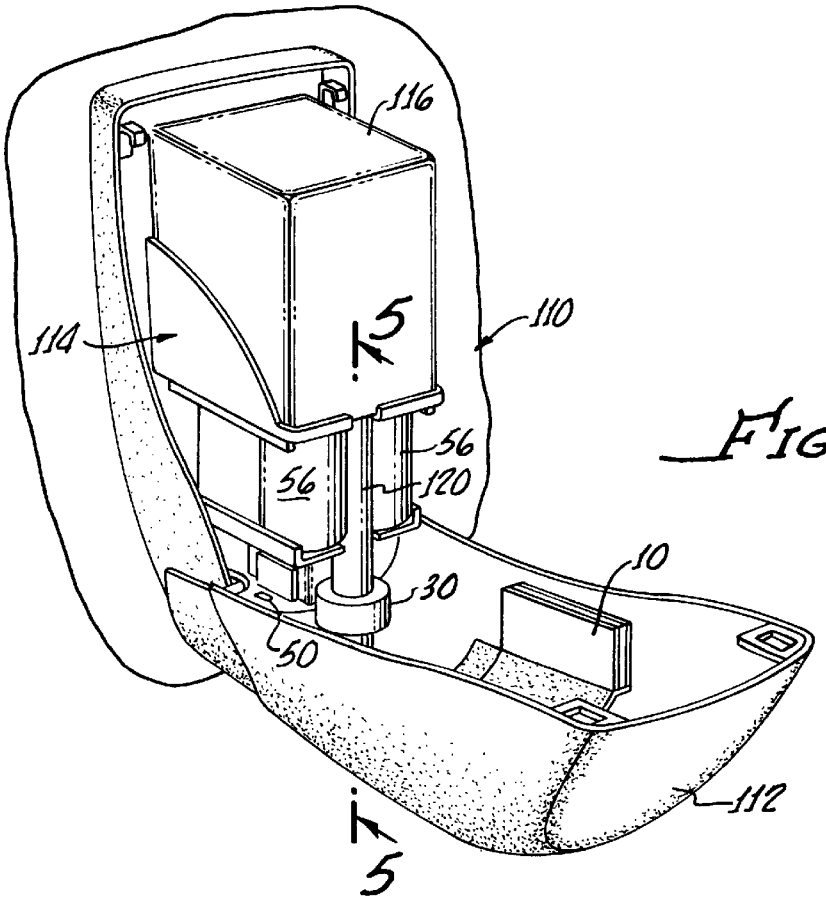
FIG. 4 is a perspective view of the dispenser shown in FIG. 3 with a case open to show a housing, a removable reservoir, and a dispensing tube attached thereto.

With reference now to FIG. 3, there is shown a fluid dispenser 110 which may be controlled by the system 10. The dispenser 110 generally includes a case 112 which may be opened, as shown in FIG. 4, to access a housing 114 along with a reservoir 116, the reservoir providing a means for containing a supply of fluid.

A tube 120 provides a means for receiving fluid flow from the reservoir 116 by the force of gravity. Preferably the tube 120 is fixed to the reservoir 116 and removable with the reservoir 116 from the housing 114. Gravitational flow of fluid into the tube 120 eliminates any need for priming the tube as well as eliminating air bubbles as is the case with many prior art devices.

Figure 5:
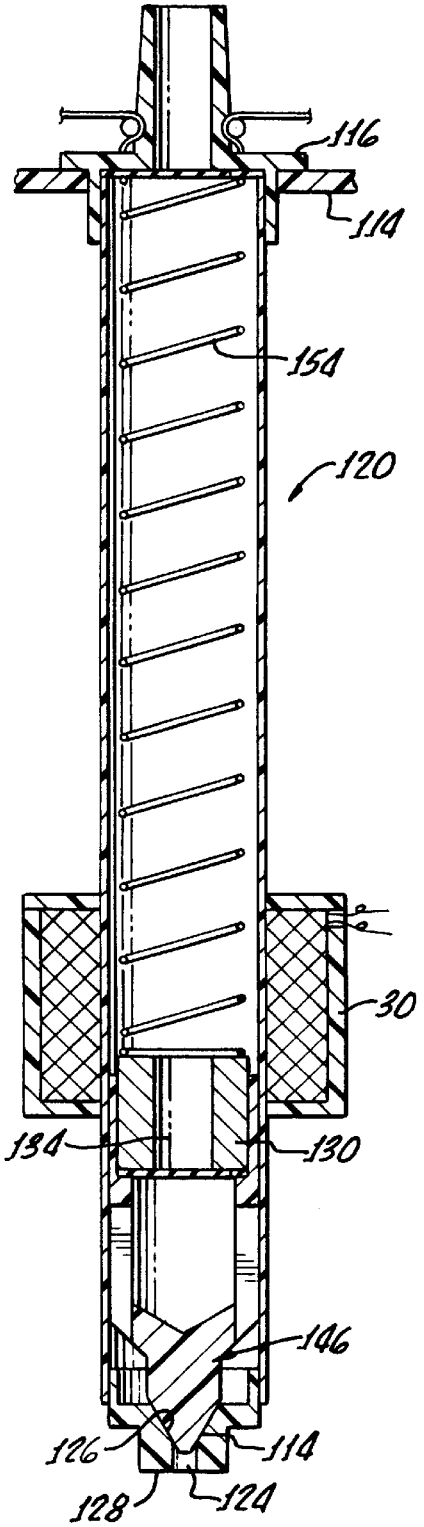
FIG. 5 is a cross sectional view of the tubular dispenser shown in FIG. 4, taken along the line 5—5, generally showing a spring and a plunger disposed within the tube.
Figure 6:
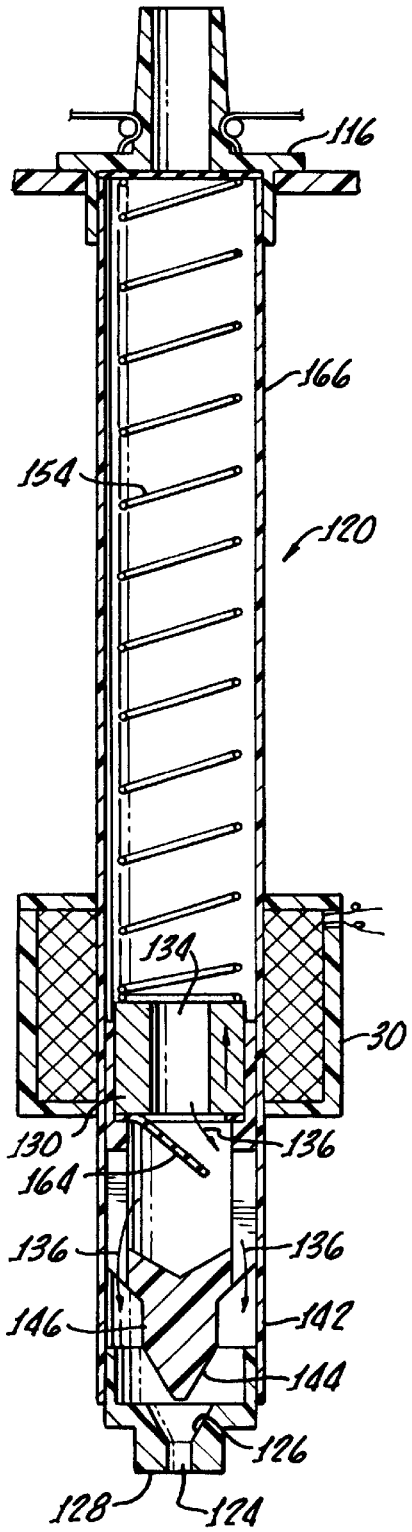
FIG. 6 is a cross sectional view similar to FIG. 5, showing movement of the plunger toward a surrounding magnetic solenoid with a first one-way valve open for enabling fluid flow into a lower portion of the tubular dispenser.

The dispensing tube 120 as shown in FIGS. 5–7 includes an orifice 124 along with a valve seat 126 at a dispensing end 128 of the tube 120.

A plunger 130 is slidably disposed within the tube 120 for movement between the first position shown in FIG. 5 and a second position shown in FIG. 7. The plunger 130 includes an opening 134 therethrough for enabling fluid to flow past the plunger 130 as shown by the arrows 136 in FIG. 6 to enable fluid flow into the lower portion 142 as will be hereinafter discussed in greater detail. A valve face 144 is provided on an end 146 of the plunger 130 for sealably engaging the valve seat 126 when the plunger 30 is in the first position. This valve arrangement adjacent the orifice 124 enables the stoppage of fluid flow without any subsequent dripping of fluid through the orifice 124, i.e., the valve is self-sealing.

As hereinabove noted and shown in FIGS. 5–7, the valve face 144 and valve seat 126 have mating angular surfaces which, by the sliding engagement therebetween, also provides for self-cleaning of the device because any build-up of fluid, or coagulated fluid is forced downward and outward during operation. This structure also provides for subsequent drip free operation.

The solenoid, or actuator, 30 is disposed and fixed to the housing 114 and adjacent the tube 120 to provide a means for magnetically engaging and moving the plunger 130 from the first position, as shown in FIG. 5, to the second position, as shown in FIG. 7. An interim position of the plunger 130 is shown in FIG. 6. Operation of the dispensing tube 120 will be hereinafter discussed in greater detail.

The solenoid 30 is activated by an electrical current to remove the plunger 130 to the second position, which is above the first position, and in which the valve face 144 is disengaged from the valve seat 126. Movement to the second position causes fluid flow past the plunger 130 into the tubular means lower portion 142, as shown by the arrow 136 in FIG. 6.

Preferably, the solenoid 30 is in the shape of a torroid which enables easy removal of the tube 120 therefrom when replacing the reservoir 116 attached thereto. Alternatively, the reservoir 116 may be manually refilled in situ, if desired. However, reliable dispensing fluid is best achieved when the reservoir 116 and 120 are removed from the housing 114 and replaced with a full reservoir 116.

A spring 154 disposed within the tube 120 provides a means for forcing the plunger 130 from the second position to the first position upon deactivation of the solenoid 30 in order to force fluid in the tube lower portion 142 through the orifice 124. Significant advantage is afforded by placement of the spring 154 within the tube 120 because the spring then becomes disposable with the reservoir 116 and tube 120. Consequently, malfunction of the spring 154, or deterioration of its properties over time, due to use or through contact with the fluid, will not occur. Further, a conventional inexpensive metal spring may be used since long term exposure to the fluid will not occur.

An additional important function of the spring is for providing a sealing force between the valve face 144 and valve seal 126, and providing force to ensure that the sliding engagement between the valve face 144 and valve seat 126 expels clotted fluid through the orifice 124.

The control system means 10, as hereinabove discussed, senses the presence of a user's palm 12 (FIG. 9) beneath the orifice 124 and provides electrical current to the solenoid 30 for a duration of time.

With reference to FIG. 6, a first one-way valve 164 may be provided for preventing fluid in the tubular means lower portion 142 past the plunger 130 as the plunger 130 moves to the first position. The valve 164 also enables fluid flow from a tube upper portion 166 into the tube lower portion 142 as the plunger 130 moves to the second position.

As shown in FIG. 7, when the solenoid 30 is deactivated, the plunger 130 is at the second position and is forced to the first position by the spring 154. The closed valve 164 thus ensures that all of the fluid disposed in the tube lower portion 142 is dispensed through the orifice 124.

It should be appreciated that the dispensing action of the tube 120 is effective without the one-way valve 164 in view of the various openings 134, orifice 124 and tube diameters. However, the most efficient operation is enabled through the use of the one-way valve 164 and a second one-way valve 168 disposed at a top 170, the valve being shown in an open position in FIG. 7.

Closure of this valve 168, as the plunger 130 moves to the second position as shown in FIG. 6, enhances the passage of fluid from the upper portion 166 of the tube 120 to the tube lower portion 142. Flow into the tube upper portion 166 occurs through the force of gravity and, further, by the drawing action of the plunger 130 as it moves from the second position to the first position, see FIG. 7, as indicated by the arrows 172. Thus, the valve 168 enhances the dispensing efficiency of the tube 120.

As shown in FIG. 8, the reservoir may include a collapsible bag 176 for accommodating pressure differentials as the fluid passes from the reservoir 16 through the top 70 of the tube 20.

Figure 10:
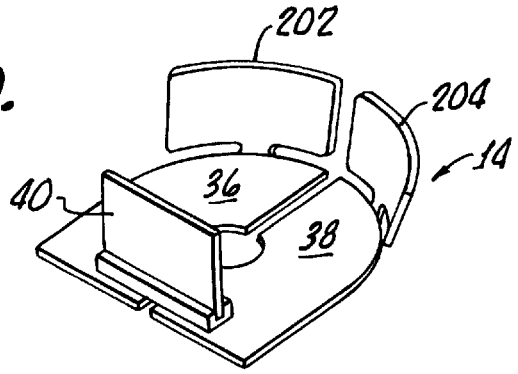
FIG. 10 is a perspective view of the Theremin antenna, a sensor, and a portion of the control system.

As shown in FIGS. 9 and 10, the Theremin antenna 14 includes spaced apart panels 36, 38 and upstanding portions 202, 204 which provides a means for enabling the antenna 14 to generally conform to the user's palm 12, as best seen in FIG. 9. This conformation provides enhanced coupling between the user's palm 12 and the Theremin antenna 14 and accordingly provides greater sensitivity. The plunger 130 and antenna 14 are vertically aligned to enable pump-like movement of the user's hand 12, as indicated by the arrow 106, to cause the control system 10 to provide pulsed electrical current to the solenoid 30 to cause pulsed release of fluid in a manner similar to conventional manual dispenser (not shown) which utilizes an activating lever.

In addition, the duration of presence of the user's palm 12 enables a corresponding duration of electrical current to the solenoid 30 via the control means 10. This causes the plunger 130 to move to a higher second position which accordingly disposes a larger fluid quantity.

Although there has been hereinabove described a control system in accordance with the present invention for the purpose of illustrating the manner to which the invention may be used to advantage, it should be appreciated that the invention is not limited thereto. Accordingly, any and all modifications, variations or equivalent arrangements which may occur to those skilled in the art, should be considered to be within the scope of the invention as defined by the appended claims.

What is claimed is:

1. A system for the dispensing of a fluid in response to the presence of a human hand, the system comprising:

a fluid dispensing device for releasing a measured amount of fluid in response to a control signal;

a theremin means for detecting the presence of the hand proximate the fluid dispenser and producing a first output signal in response to the detection;

sensor means for independently detecting the presence of the hand proximate the fluid dispenser and producing a second output signal in response to the independent detection; and a processor for determining the simultaneous presence of both the first and second output signals and in response thereto producing the control signal.

2. The system according to claim 1 wherein said theremin means includes two closely spaced but separated antenna panel means for establishing a capacitance therebetween independent of any ground connection, said capacitance changing due to the presence of the human body part to provide the first output signal.

3. The improvement according to claim 2 further comprising first oscillator means connected between the two antenna panels for providing the output corresponding to the capacitance between the two antenna panels.

4. The improvement according to claim 3 further comprising a second oscillator and comparator means for matching an output from the second oscillator with the first oscillator means output and providing a control current for the device in response thereto.

5. The system according to claim 1 wherein said sensor means comprises a theremin.

6. The system according to claim 1 wherein said sensor means comprises an infrared detector.

7. The system according to claim 1 wherein said sensor means comprises an ultrasonic detector.

8. The system according to claim 1 wherein said sensor means comprises a heat sensor.

9. The system according to claim 1 wherein said sensor means comprises a visible light detector.

10. The system according to claim 1 wherein said sensor means comprises a proximity detector.

11. The system according to claim 1 wherein said sensor means comprises an audio detector.

* * * * *